US007669735B1

(12) United States Patent
Alleyne

(10) Patent No.: US 7,669,735 B1
(45) Date of Patent: Mar. 2, 2010

(54) TOOTHPASTE DISPENSER

(76) Inventor: Lorris L. Alleyne, 96 Colonial Dr., Massapequa, NY (US) 11758

( * ) Notice: Subject to any disclaimer, the term of this patent is extended or adjusted under 35 U.S.C. 154(b) by 492 days.

(21) Appl. No.: 11/655,624

(22) Filed: Jan. 19, 2007

(51) Int. Cl.
*B65D 35/28* (2006.01)

(52) U.S. Cl. ..... 222/102; 222/333

(58) Field of Classification Search ..... 222/101, 222/102, 333
See application file for complete search history.

(56) References Cited

U.S. PATENT DOCUMENTS 4,258,864 A * 3/1981 Karamanolis et al. ..... 222/101
5,050,773 A * 9/1991 Choi ..... 222/102
5,199,610 A * 4/1993 Gagliardi ..... 222/101
5,875,929 A * 3/1999 Nguyen ..... 222/102
6,401,977 B1 * 6/2002 Ross, III ..... 222/333
6,454,133 B1 * 9/2002 Lopez et al. ..... 222/102
2001/0050290 A1 * 12/2001 Sampson et al. ..... 222/102

* cited by examiner

*Primary Examiner*—Kenneth Bomberg

(57) ABSTRACT

A toothpaste dispenser is disclosed. An illustrative embodiment of the toothpaste dispenser includes a base, a roller mount arm carried by the base, a motor carried by the roller mount arm and drivingly engaging the base and a pair of rollers carried by the roller mount arm.

3 Claims, 8 Drawing Sheets

FIG. 9
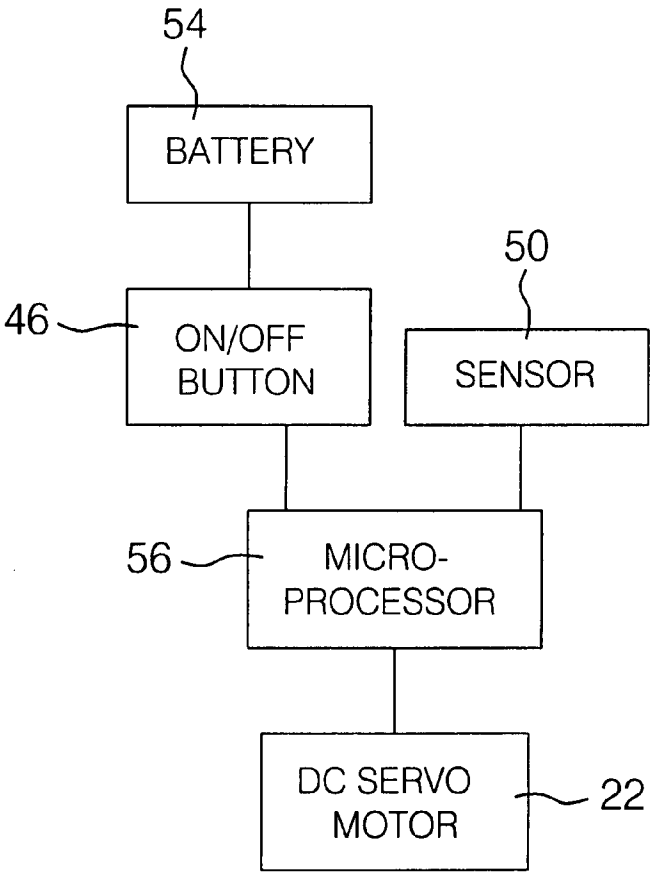
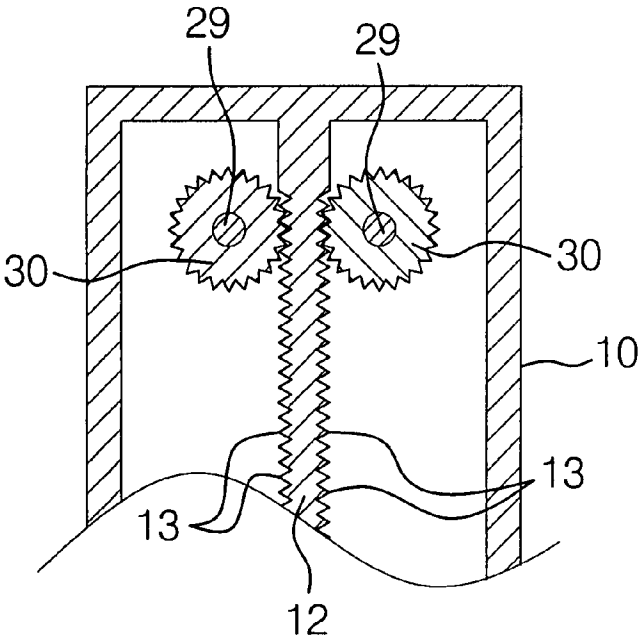
FIG. 8

TOOTHPASTE DISPENSER

FIELD

The present invention relates to toothpaste. More particularly, the present invention relates to a toothpaste dispenser for dispensing toothpaste from a toothpaste tube.

BACKGROUND

Toothpaste tubes are frequently squeezed to expel the toothpaste contents from the tubes. However, this creates a mess and results in inefficient utilization of the tube contents. Therefore, a toothpaste dispenser is needed which facilitates the efficient dispensing of toothpaste from a toothpaste tube.

SUMMARY

The present invention is generally directed to a toothpaste dispenser. An illustrative embodiment of the toothpaste dispenser includes a base, a roller mount arm carried by the base, a motor carried by the roller mount arm and drivingly engaging the base and a pair of rollers carried by the roller mount arm.

BRIEF DESCRIPTION OF THE DRAWINGS

The invention will now be described, by way of example, with reference to the accompanying drawings, in which:

FIG. 8 is a sectional view, taken along section lines 8-8 in FIG. 6; and FIG. 9 is a block diagram which illustrates functional components of an illustrative embodiment of the toothpaste dispenser.

DETAILED DESCRIPTION

Figure 1:
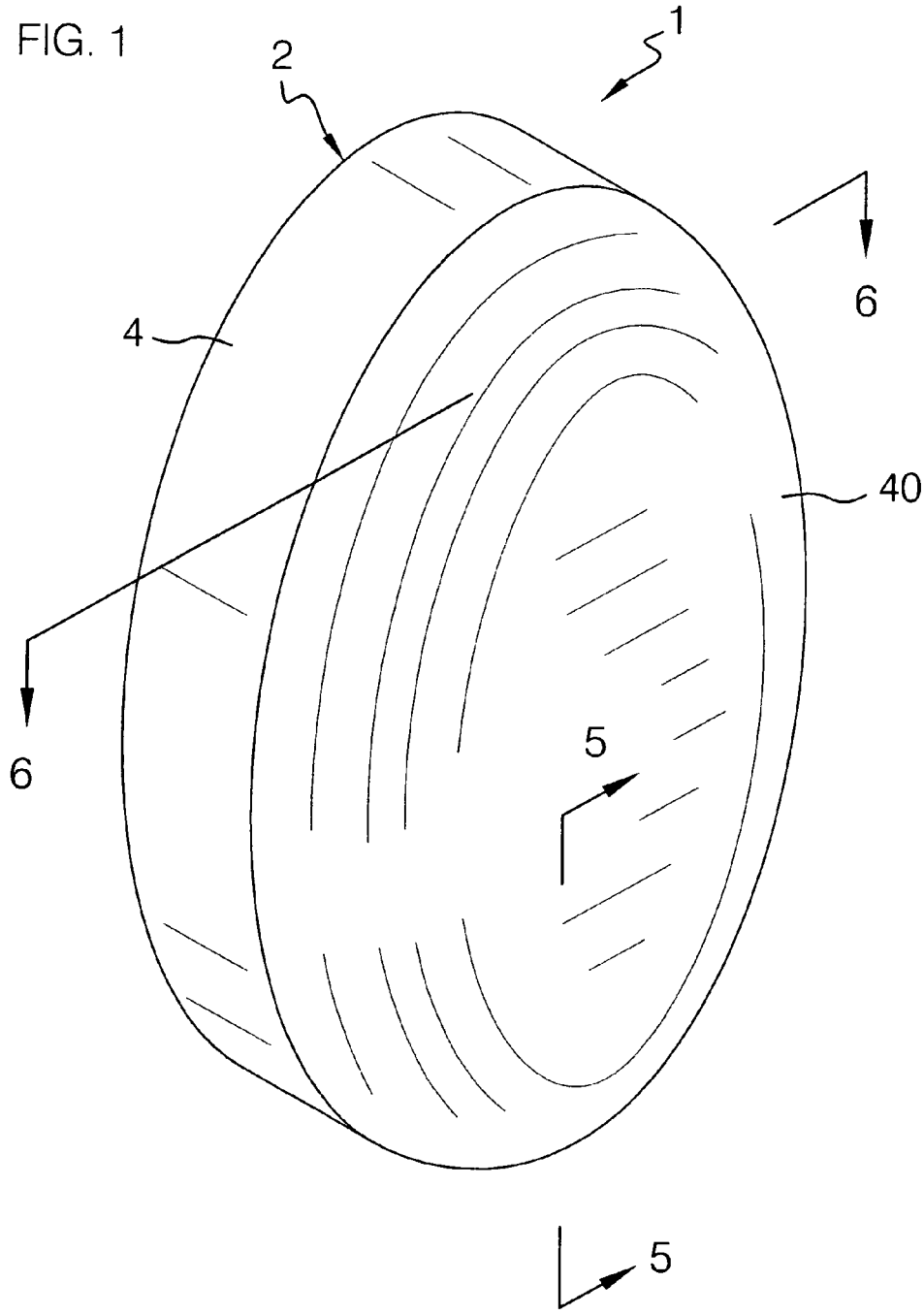
FIG. 1 is a front perspective view of an illustrative embodiment of the toothpaste dispenser in a closed position.
Figure 2:
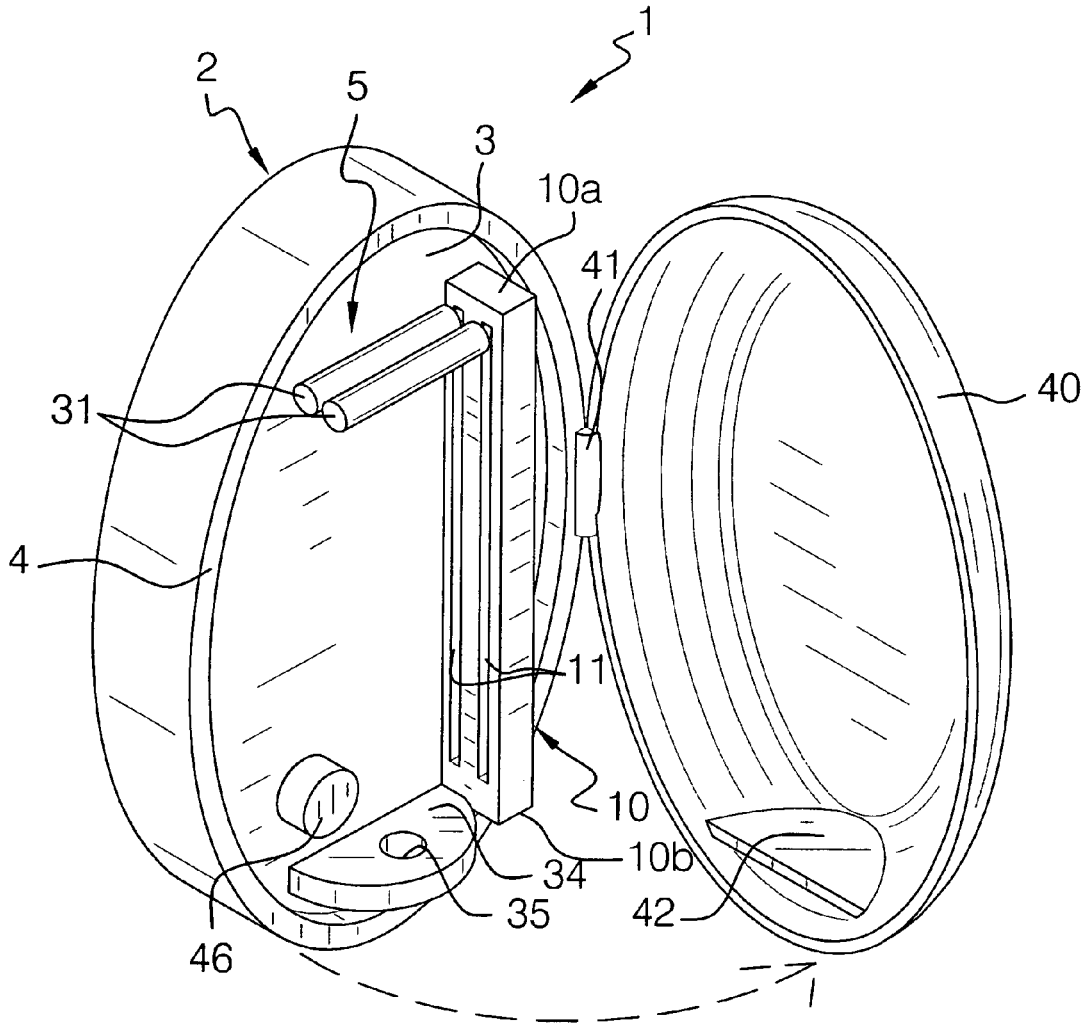
FIG. 2 is a front perspective view of an illustrative embodiment of the toothpaste dispenser in an open position.
Figure 3:
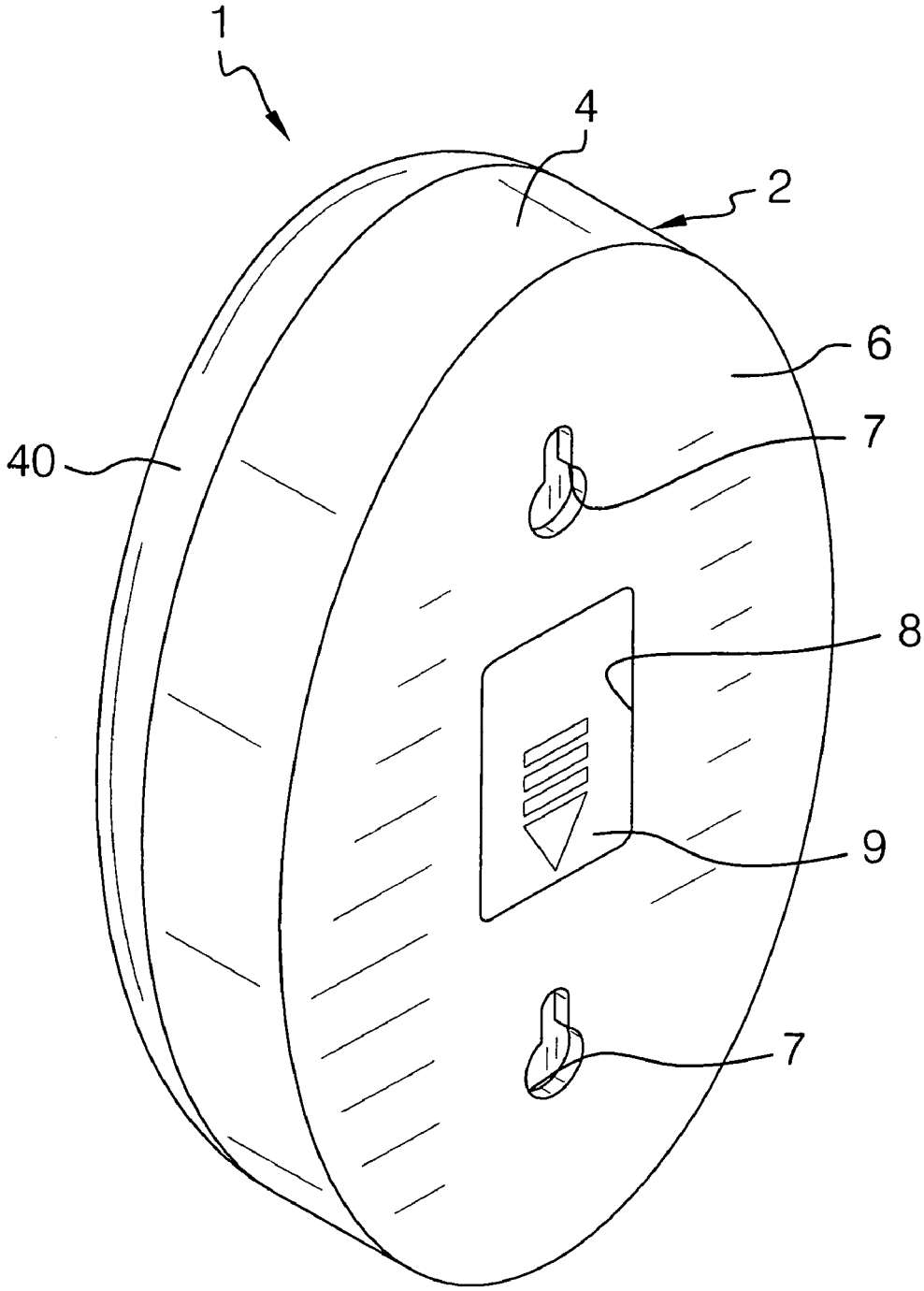
FIG. 3 is a rear perspective view of an illustrative embodiment of the toothpaste dispenser in a closed position.
Figure 4:
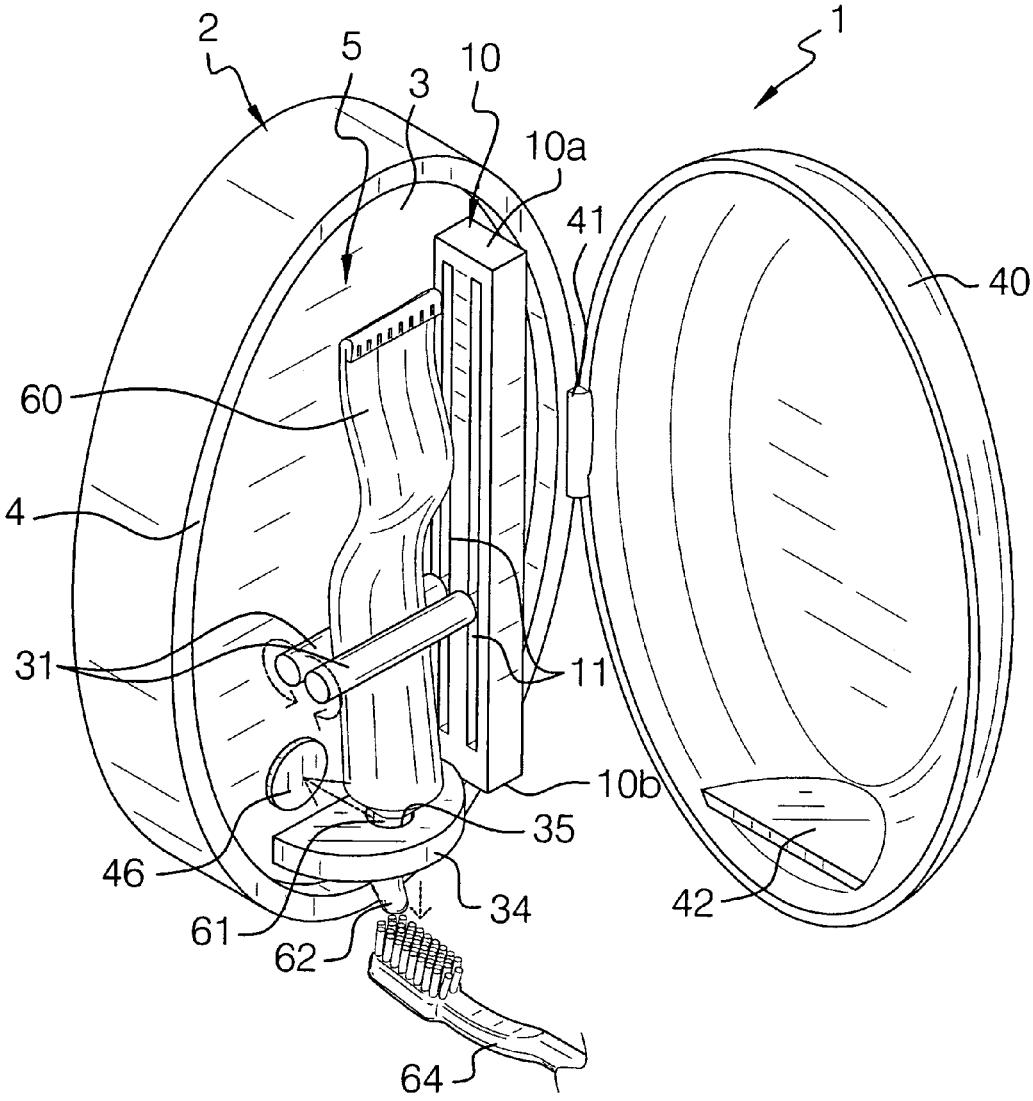
FIG. 4 is a front perspective view of an illustrative embodiment of the toothpaste dispenser in an open position, more particularly illustrating a tube of toothpaste installed in the toothpaste dispenser and toothpaste being dispensed from the tube.
Figure 6:
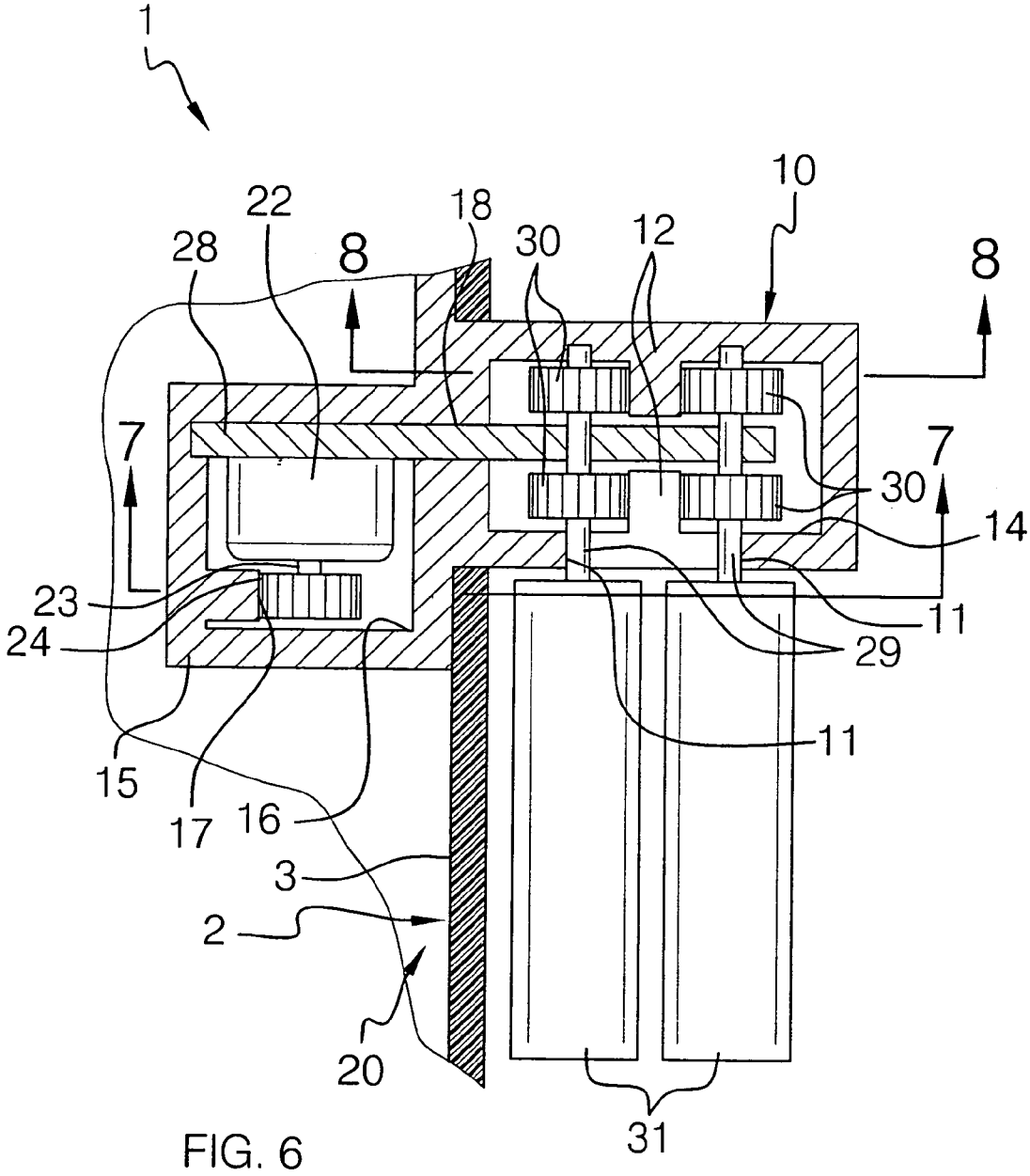
FIG. 6 is a sectional view, taken along section lines 6-6 in FIG. 1, more particularly illustrating a typical drive mechanism for a pair of rollers provided in the toothpaste dispenser.
Figure 7:
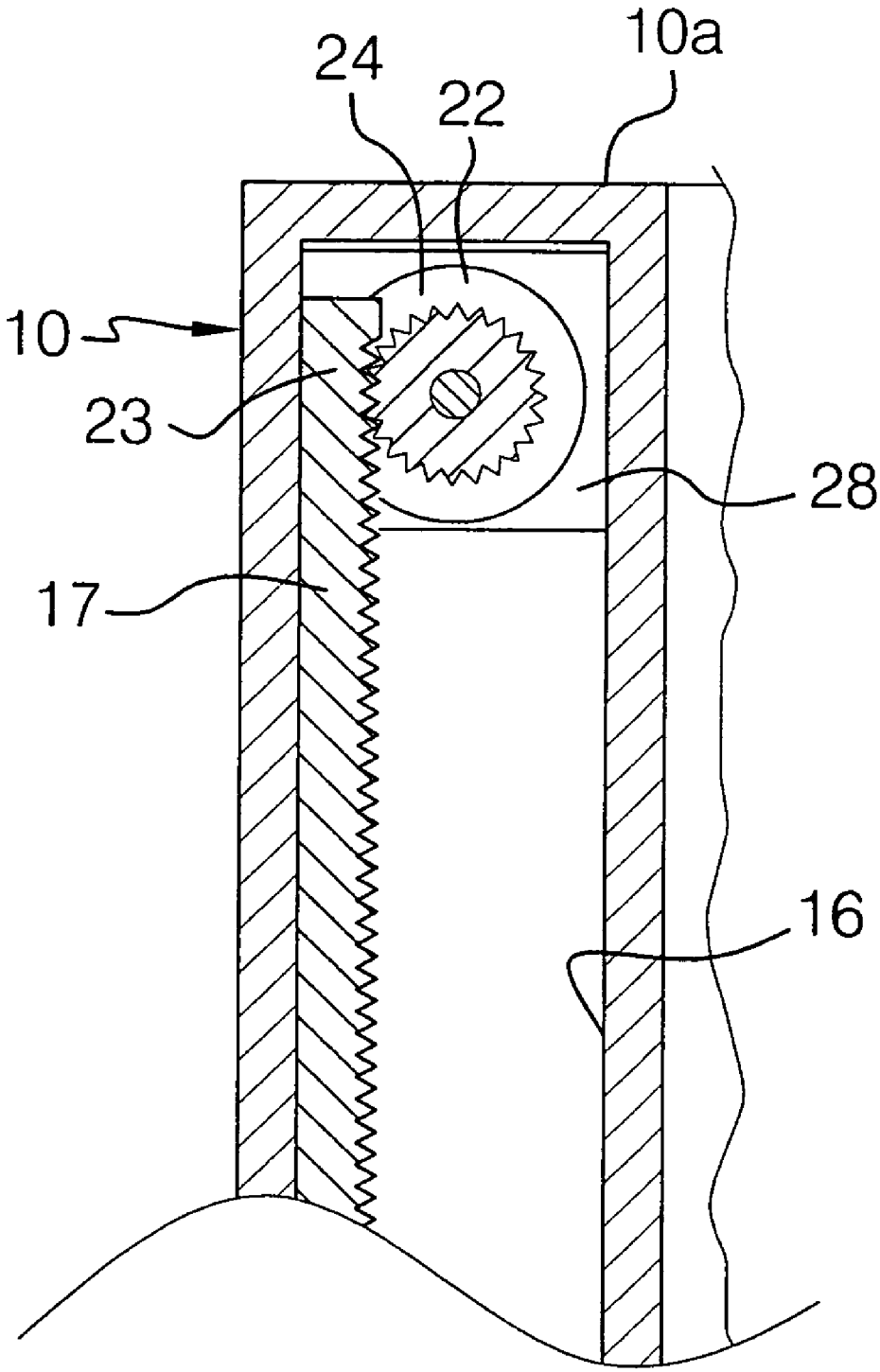
FIG. 7 is a sectional view, taken along section lines 7-7 in FIG. 6.

Referring to the drawings, an illustrative embodiment of the toothpaste dispenser is generally indicated by reference numeral 1. The toothpaste dispenser 1 includes a base 2. In some embodiments, a lid 40 is pivotally attached to the base 2 at a hinge 41. As shown in FIGS. 2 and 4, a lid flange 42 may be provided in the lid 40. The base 2 typically includes a base panel 3 and a base wall 4 which extends from the base panel 3. As shown in FIGS. 2 and 4, the base panel 3 and the base wall 4 define a base interior 5. As shown in FIG. 3, in some embodiments, a base back 6 is provided on the base wall 4 in spaced-apart relationship with respect to the base panel 3. Mount openings 7 may be provided in the base back 6 to facilitate mounting of the base 2 on a surface (not shown). A battery compartment 8, closed by a battery compartment lid 9, is typically further provided in the base back 6. As shown in FIG. 6, a base compartment 20 is defined between the base panel 3 and the base back 6.

As shown in FIGS. 2 and 4, an elongated roller housing 10 is provided on the base panel 3, in the base interior 5. For purposes of description herein, the roller housing 10 has a roller start end 10*a* and a roller finish end 10*b*. A pair of generally elongated, parallel, spaced-apart roller slots 11 is provided in the roller housing 10. As shown in FIG. 6, the roller housing 10 has a housing interior 14 which communicates with the roller slots 11. A pair of housing partitions 12 extends into the housing interior 14. As shown in FIG. 8, partition teeth 13 extend from each surface of each housing partition 12 for purposes which will be hereinafter described. A tube holder 34, having a holder opening 35, extends from the base panel 3, generally adjacent and perpendicular with respect to the roller housing 10.

As further shown in FIG. 6, a motor housing 15 extends from the base panel 3, into the base compartment 20 of the base 2. The motor housing 15 has a motor compartment 16. A toothed motor track 17 extends along the interior of the motor compartment 16. An arm slot 18 establishes communication between the housing interior 14 of the roller housing 10 and the motor compartment 16 of the motor housing 15.

An elongated roller mount arm 28 extends through the arm slot 18, into the motor compartment 16 of the motor housing 15 and the housing interior 14 of the roller housing 10. A motor 22, such as an electric DC servo motor, for example, is provided on the roller mount arm 28 in the motor compartment 16. The motor 22 drivingly engages a drive shaft 23. A drive sprocket 24 is provided on the drive shaft 23 and meshes with the motor track 17. Accordingly, responsive to operation of the motor 22, which will be hereinafter further described, the roller mount arm 28 traverses the arm slot 18 throughout substantially the entire length of the roller housing 10 and the motor housing 15.

As further shown in FIG. 6, at least one roller sprocket 30 is rotatably mounted on the roller mount arm 28. In some embodiments, four roller sprockets 30 are rotatably mounted on the roller mount arm 28. A pair of spaced-apart roller shafts 29 extends through respective shaft openings (not numbered) provided in the roller mount arm 28. A pair of roller sprockets 30 is rotatably mounted on each roller sprocket shaft 29. As shown in FIG. 8, the roller sprockets 30 mesh with the partition teeth 13 provided on each surface of the housing partition 12. The roller shafts 29 further extend through the respective roller slots 11 provided in the roller housing 10. A generally elongated, parallel roller 31 is provided on each roller shaft 29. The rollers 31 are disposed in generally parallel, adjacent, spaced-apart relationship with respect to each other. Therefore, as the roller mount arm 28 is driven through the arm slot 18 along the longitudinal axis of the roller housing 10 by operation of the motor 22, the roller sprockets 30 rotate on the housing partitions 12 in the housing interior 14. Simultaneously, the roller sprockets 30 rotate the respective roller shafts 29 which, in turn, rotate the respective rollers 31.

Figure 5:
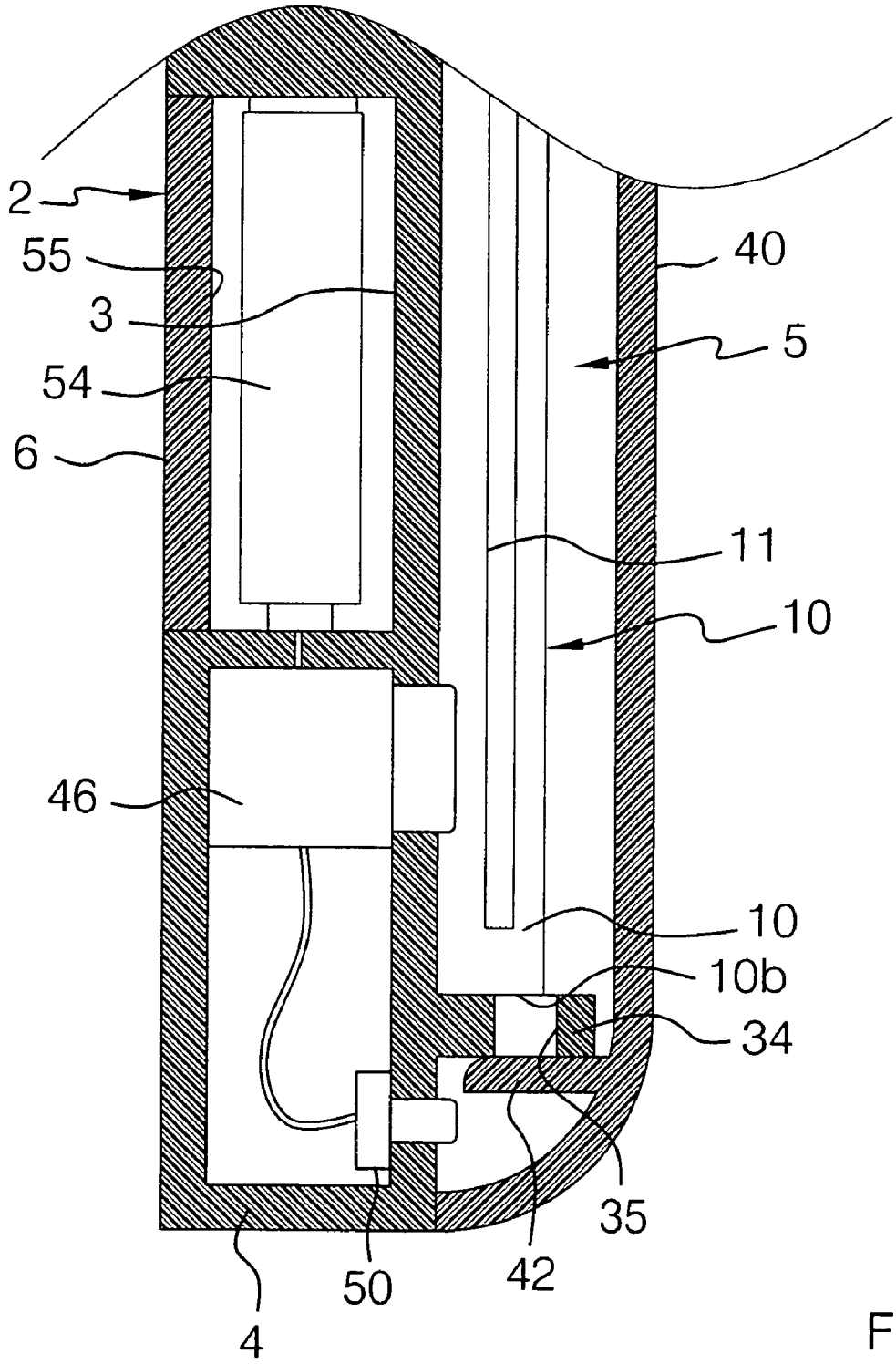
FIG. 5 is a sectional view, taken along section lines 5-5 in FIG. 1.

As shown in FIG. 9, a microprocessor 56 is connected to the motor 22. A power button 46 is connected to the microprocessor 56. Accordingly, responsive to manipulation of the power button 46, the microprocessor 22 turns the motor 22 on and off. The power button 46 may be provided in any suitable accessible location on the base 2, such as on the base panel 3 in the base interior 5, for example, as shown in FIGS. 4 and 5. At least one battery 54 is connected to the power button 46. As shown in FIG. 5, the at least one battery 54 may be provided in a battery compartment 55 which is typically between the base panel 3 and the base back 6 of the base 2, for example. The power button 46 may include a directional control feature which facilitates directional operation of the motor 22 and traversal of the roller mount arm 28 and rollers 31 in a selected direction along the roller housing 10.

As further shown in FIG. 9, in some embodiments of the toothpaste dispenser 1, a motion sensor 50 is connected to the microprocessor 56. The motion sensor 50 is provided in any suitable location on the base 2 such as, for example, on the base panel 3 generally beneath or adjacent to the tube holder 34, as shown in FIG. 5. The motion sensor 50 is typically provided adjacent to the holder opening 35 (FIG. 4) of the tube holder 34. Accordingly, upon the sensing of motion adjacent to the holder opening 35, the motion sensor 50 transmits a motion signal to the microprocessor 56. In turn, the microprocessor 56 actuates the motor 22, which drives the roller mount arm 28 (FIG. 6) along the arm slot 18 and the rollers 31 along the roller housing 10. When the motion sensor 50 no longer senses motion adjacent to the holder opening 35, the microprocessor 56 terminates operation of the motor 22.

As shown in FIG. 4, in typical application of the toothpaste dispenser 1, the motor 22 is initially operated to position the rollers 31 at or near the roller start end 10*a* of the roller housing 10. A toothpaste tube 60, which contains a supply of toothpaste 62, is placed in the base interior 5, between the rollers 31, with the spout 61 of the toothpaste tube 60 extending through the holder opening 35 of the tube holder 34, as shown in FIG. 4. Upon placement of a toothbrush 64 beneath or adjacent to the holder opening 35 of the tube holder 34, the motion sensor 50 senses motion of the toothbrush 64 thereby actuating the motor 22. Consequently, the motor 22 drives the roller mount arm 28 along the arm slot 18, and therefore, the rollers 31 along the toothpaste tube 60, toward the roller finish end 10*b* of the roller housing 10. Therefore, the rollers 31 compress the toothpaste tube 60, forcing the toothpaste 62 from the spout 61 and onto the toothbrush 64. When the toothbrush 64 is removed from its position adjacent to the holder opening 35, the microprocessor 56 (FIG. 9) terminates operation of the motor 22. Each time the toothbrush 64 is positioned adjacent to the holder opening 35, the motor 22 is actuated, forcing the rollers 31 further along the toothpaste tube 60 toward the spout 61 and expelling toothpaste 62 from the toothpaste tube 60. Consequently, the toothpaste 62 is sequentially expelled from the toothpaste tube 60 in an even and efficient manner and with minimal effort. As shown in FIG. 5, when the lid 40 is closed, the lid flange 42 of the lid 40 fits adjacent to or beneath the holder opening 35 in the tube holder 34 of the base 2.

While the preferred embodiments of the invention have been described above, it will be recognized and understood that various modifications can be made in the invention and the appended claims are intended to cover all such modifications which may fall within the spirit and scope of the invention.

What is claimed is:

1. A toothpaste dispenser, comprising;

a base having a base panel, a base wall extending from said base panel, a base back carried by said base wall in spaced-apart relationship with respect to said base panel, a base interior defined by said base wall and said base panel and a base compartment defined between said base panel and said base back;

a tube holder having a holder opening extending from said base panel into said base interior;

a roller housing extending from said base panel into said base interior;

a pair of generally elongated, parallel, spaced-apart roller slots provided in said roller housing;

a motor housing extending from said base panel into said base compartment;

a motor track provided in said motor housing;

a motor drivingly engaging said motor track;

a roller mount arm carried by said motor;

an arm slot extending between said roller housing and said motor housing and receiving said roller mount arm;

a pair of roller shafts carried by said roller mount arm in said roller housing and extending through said pair of roller slots, respectively;

a pair of generally elongated, cylindrical, parallel rollers carried by said pair of roller shafts, respectively;

a battery connected to said motor; and a power switch provided between said battery and said motor.

2. The toothpaste dispenser of claim 1 further comprising a lid pivotally carried by said base.

3. The toothpaste dispenser of claim 1 further comprising a microprocessor between said power button and said motor and a motion sensor connected to said microprocessor.

* * * * *